US007807912B2

(12) United States Patent
Tsumeishi

(10) Patent No.: US 7,807,912 B2
(45) Date of Patent: Oct. 5, 2010

(54) KEY FOR KEYBOARD INSTRUMENT

(75) Inventor: Takeshi Tsumeishi, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 12/172,001

(22) Filed: Jul. 11, 2008

(65) Prior Publication Data

US 2009/0019987 A1 Jan. 22, 2009

(30) Foreign Application Priority Data

Jul. 17, 2007 (JP) ..... 2007-185410

(51) Int. Cl.
*G10C 3/12* (2006.01)

(52) U.S. Cl. ..... 84/433; 84/243

(58) Field of Classification Search ..... 84/433, 84/243, 434, 435, 436
See application file for complete search history.

(56) References Cited

U.S. PATENT DOCUMENTS 3,507,527 A * 4/1970 White ..... 403/140
3,738,216 A * 6/1973 Slaats et al. ..... 84/433
4,685,371 A * 8/1987 Levinson ..... 84/239
5,185,490 A * 2/1993 Vandervoort ..... 84/436
5,726,374 A * 3/1998 Vandervoort ..... 84/638

FOREIGN PATENT DOCUMENTS

JP H09-258720 10/1997

* cited by examiner

*Primary Examiner*—Jianchun Qin
(74) *Attorney, Agent, or Firm*—Crowell & Moring LLP

(57) ABSTRACT

A key for a keyboard instrument, which is capable of maintaining the excellent abrasion resistance and lubricity of bushing cloth for a long time period, thereby making it possible not only to stably ensure a smooth pivotal motion of the key but also to manufacture the key at lower costs. The key is mounted in a state engaged with a pin and is pivotally moved in accordance with depression thereof. The key has a key stick formed with a pin hole having left and right wall surfaces opposed to each other and opening downward, and is pivotally engaged with the pin via the pin hole. Bushing cloth sheets are made of fluorocarbon resin fibers, and are affixed to the left and right wall surfaces of the pin hole.

1 Claim, 4 Drawing Sheets

F I G. 6

| | EMBODIMENT | COMPARATIVE EXAMPLE |
|---|---|---|
| APPEARANCE | NOT CHANGED | COLOR CHANGED |
| TOUCH FEELING | NOT CHANGED | CHANGED |

KEY FOR KEYBOARD INSTRUMENT

BACKGROUND OF THE INVENTION

1. Field of the Invention

The present invention relates to a key for a keyboard instrument, which is pivotally moved in accordance with key depression, and more particularly to a key for an acoustic piano and the like, which uses bushing cloth in engaging portions for engaging between the key and pins.

2. Description of the Related Art

Conventionally, as a key for a keyboard instrument of this kind, one disclosed in Japanese Laid-Open Patent Publication (Kokai) No. H09-258720 is known. This key is for an upright piano, and includes a key stick extending in a front-rear direction. The key stick has a balance rail pin hole formed in the center thereof such that it vertically extends therethrough. The balance rail pin hole has left and right wall surfaces opposed to each other, and sheets of bushing cloth are affixed to the respective left and right wall surfaces. Further, the key stick has a front rail pin hole formed in a front end of a lower surface thereof such that it opens downward. Sheets of bushing cloth are also affixed to respective left and right wall surfaces of the front rail pin hole.

The above bushing cloth is formed by coating woolen cloth with a fluorocarbon resin, and is manufactured as follows: First, cloth formed by weaving wool fibers is immersed in an aqueous solution of a fluorocarbon resin to be impregnated therewith such that the cloth is saturated with the fluorocarbon resin to thereby coat the surfaces of the wool fibers with the fluorocarbon resin. Next, the cloth is taken out of the aqueous solution of the fluorocarbon resin, and is then sequentially dried and heated at a predetermined temperature for a predetermined time period to cure the fluorocarbon resin, whereby the bushing cloth is manufactured.

The key configured as above is pivotally supported by a keyframe in a state in which the balance rail pin hole is engaged with a balance rail pin via the bushing cloth sheets affixed to the left and right wall surfaces of the balance rail pin. Further, the front rail pin hole is engaged with a front rail pin via the bushing cloth sheets affixed to the left and right wall surfaces of the front rail pin hole. When the key is depressed, the key is pivotally moved about the balance rail pin. At this time, the bushing cloth affixed to the balance rail pin hole and the front rail pin hole is brought into sliding contact with the balance rail pin and the front rail pin, respectively. Further, shakes of the key in a left-right direction are prevented by the front rail pin.

However, the conventional bushing cloth is formed simply by coating the surfaces of the wool fibers with the fluorocarbon resin, and hence when the bushing cloth is repeatedly slid along the balance rail pin and the like in accordance with key depressions, the fluorocarbon resin can wear or fall off the surfaces of the wool fibers. In this case, the wool fibers are exposed to be brought into direct contact with e.g. the balance rail pin. In this state, since the abrasion resistance of the wool fibers is lower than that of the fluorocarbon resin, the abrasion of the bushing cloth is advanced to make wobbling of the key liable to occur. Further, since the lubricity of the wool fibers is lower than that of the fluorocarbon resin, noise becomes liable to occur during the pivotal motion of the key, which obstructs the smooth pivotal motions of the key.

Further, as described above, to coat the surfaces of the wool fibers with the fluorocarbon resin, the bushing cloth is required to be manufactured through a large number of steps e.g. of impregnation, drying and heating of the fluorocarbon resin. This causes an increase in the manufacturing costs of the key.

SUMMARY OF THE INVENTION

It is an object of the present invention to provide a key for a keyboard instrument, which is capable of maintaining the excellent abrasion resistance and lubricity of bushing cloth for a long time period, thereby making it possible not only to stably ensure a smooth pivotal motion of the key but also to manufacture the key at lower costs.

To attain the above object, the present invention provides a key for a keyboard instrument, the key being mounted in a state engaged with a pin and being pivotally moved in accordance with depression of the key, comprising a key stick that has a pin hole formed therein, the pin hole having left and right wall surfaces opposed to each other, and opening downward, the key stick being pivotally engaged with the pin via the pin hole, and sheets of bushing cloth that are each made of fluorocarbon resin fibers, and are affixed to the left and right wall surfaces of the pin hole, respectively.

With the construction of the key according to the present invention, the key is pivotally moved in accordance with depression of the key, and when the key is pivotally moved, the sheets of bushing cloth affixed to the left and right wall surfaces of the pin hole slide in contact with the pin to serve to prevent the key from wobbling and generating noise.

In the present invention, the bushing cloth is made of fluorocarbon resin fibers, so that even when environments, such as humidity, are changed, the bushing cloth is not swelled or contracted, whereby the distance between the left and right bushing cloth sheets of each pin hole is held approximately constant. Further, the fluorocarbon resin has high abrasion resistance and lubricity, and all the fibers forming the bushing cloth are made of the fluorocarbon resin, so that even when the surface of the bushing cloth is worn due to a long-term use of the bushing cloth, the excellent abrasion resistance and lubricity of the bushing cloth are maintained. As a result, it is possible to stably ensure the smooth pivotal motion of the key while preventing the key from becoming wobbly due to advance of the abrasion of the bushing cloth sheets, and generating noise due to degraded lubricity of the same.

Further, all the fibers forming the bushing cloth are made of the fluorocarbon resin, and therefore differently from the conventional bushing cloth, it is possible to dispense with steps e.g. of impregnation for coating the bushing cloth with the fluorocarbon resin, thereby making it possible to use commercially available fluorocarbon resin fibers. This makes it possible to reduce the manufacturing costs of the bushing cloth, thereby making it possible to manufacture the key at lower costs.

The above and other objects, features, and advantages of the present invention will become more apparent from the following detailed description taken in conjunction with the accompanying drawings.

BRIEF DESCRIPTION OF THE DRAWINGS

FIG. 6 is a diagram showing results of a durability test performed on a bushing cloth.

DETAILED DESCRIPTION OF PREFERRED EMBODIMENTS

Figure 1:
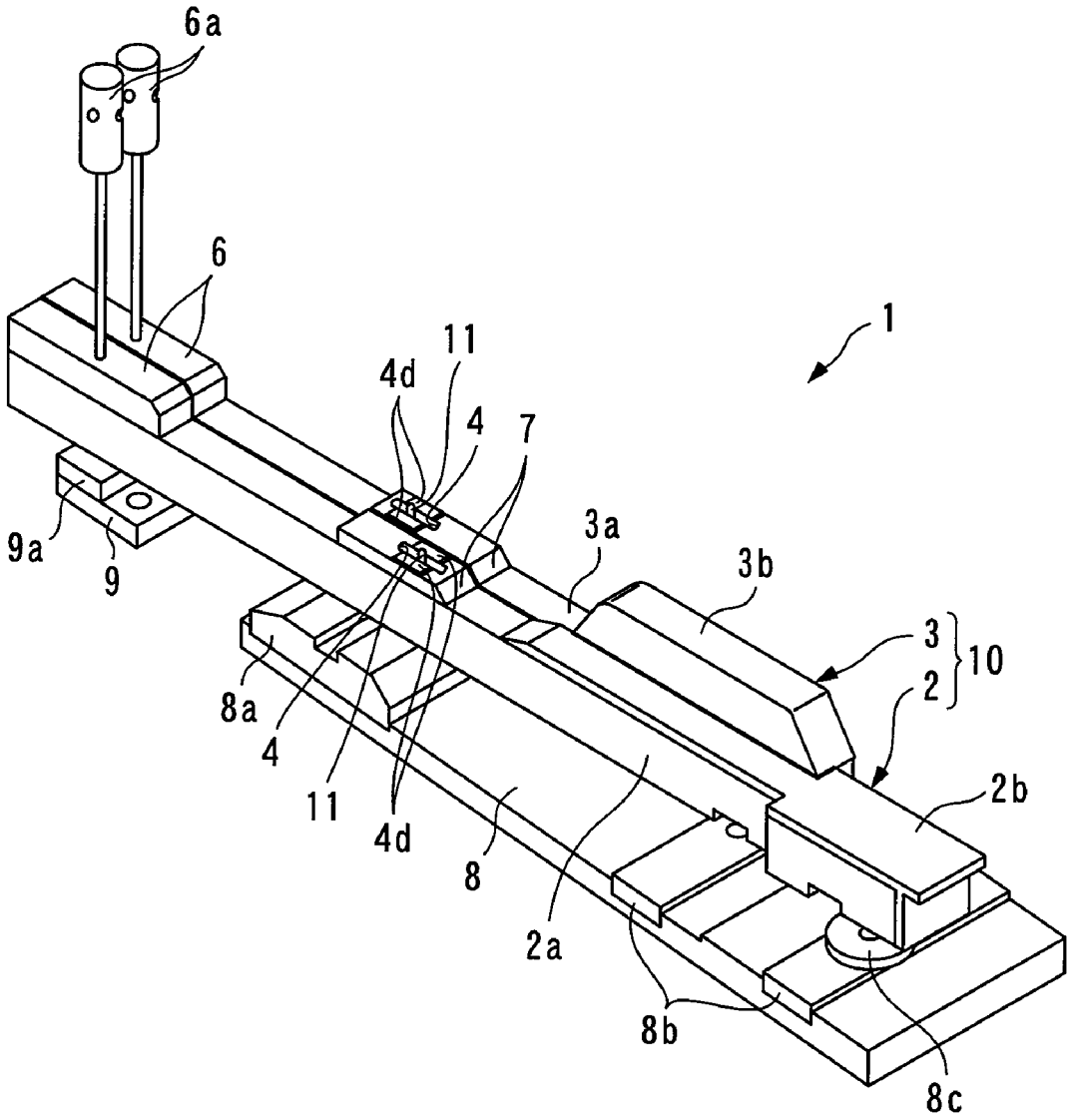
FIG. 1 is a perspective view of a keyboard assembly for an upright piano that uses keys according to the present invention.

The invention will now be described in detail with reference to the drawings showing a preferred embodiment thereof. FIG. 1 shows a keyboard assembly for an upright piano according to an embodiment of the present invention. The keyboard assembly 1 is comprised of a large number of white keys 2 (only one of which is shown) and black keys 3 (only one of which is shown). It should be noted that in the following description, the white keys 2 and black keys 3 are generically referred to as "the keys 10" as deemed appropriate.

Each white key 2 includes a key stick 2*a* and a white key cover 2*b* mounted on a front portion of the key stick 2*a*. The key stick 2*a* is made of a wooden material, such as spruce. The key stick 2 extends in a front-rear direction, and has a rectangular shape in cross section. Further, the white key cover 2*b*, which is made of a molded article of a synthetic resin, such as an acrylic resin, has an L shape in side view, and is affixed from a front half of an upper surface of the key stick 2*a* to a front surface thereof in a manner covering the same. Each black key 3 includes a key stick 3*a* which is shorter than the key stick 2*a* of the white key 2, and a black key cover 3*b* which is affixed to a front portion of an upper surface of the key stick 3*a*, and is made of a molded article of a synthetic resin, such as a phenolic resin.

The remainder of the construction of the white key 2 and that of the construction of the black key 3 are basically the same, and hence the following description will be given of the white key 2 as a representative of the two keys. Mounted on a rear end of the upper surface of the key stick 2*a* is a capstan block 6 which is made of wood harder than the key stick 2*a*. A capstan 6*a* is erected on the capstan block 6. An action and a hammer (neither of which is shown) are provided above the capstan 6*a*.

Figure 2:
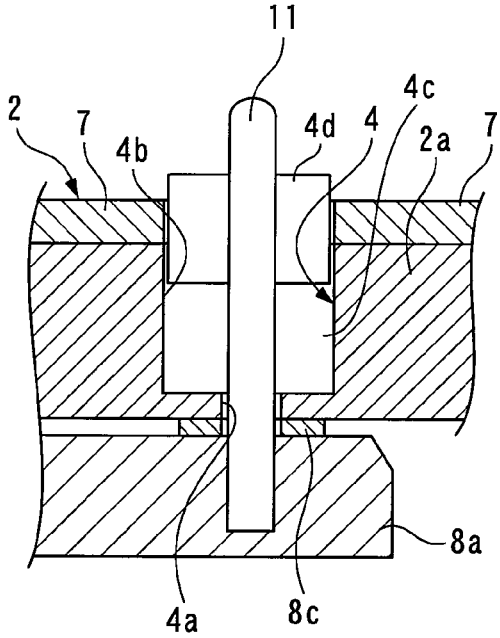
FIG. 2 is a partial longitudinal cross-sectional view of an engaging portion for engaging between a balance rail pin and the key.
Figure 3:
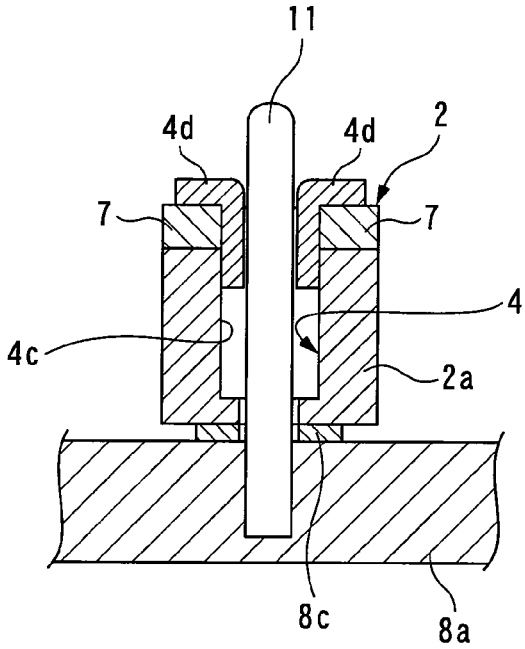
FIG. 3 is a partial transverse cross-sectional view of the engaging portion for engaging between the balance rail pin and the key.

Further, a middle plate 7 made of hard wood is affixed to a central portion of the upper surface of the key stick 2*a*. A balance rail pin hole 4 is formed in the key stick 2*a* and the middle plate 7 such that it vertically extends therethrough. As shown in FIGS. 2 and 3, the balance rail pin hole 4 is comprised of a round hole 4*a* formed in a lower end of the key stick 2*a*, and a guide slot 4*b* continuous with a top of the round hole 4*a*. The guide slot 4*b* is formed by left and right wall surfaces 4*c* and 4*c* opposed to each other, and extends in the front-rear direction.

A pair of left and right pieces 4*d* and 4*d* of bushing cloth (hereinafter referred to as "the bushing cloth sheets 4*d*") are affixed to the balance rail pin hole 4 from upper portions of the respective wall surfaces 4*c* and 4*c* of the guide slot 4*b* to an upper surface of the middle plate 7 and are formed such that the bushing cloth sheets 4*d* each have an L shape. The bushing cloth sheets 4*d* are made of fluorocarbon resin fiber sheets. Differently from the above-described conventional bushing cloth, all the fibers of the fiber sheets are made of a fluorocarbon resin, such as PTFE (polytetrafluoroethylene), and as the fiber sheets, there are used commercially available fiber sheets having a predetermined thickness (e.g. 1.3 mm) and a predetermined weight per unit area (e.g. 900 g/m$^2$).

Figure 4:
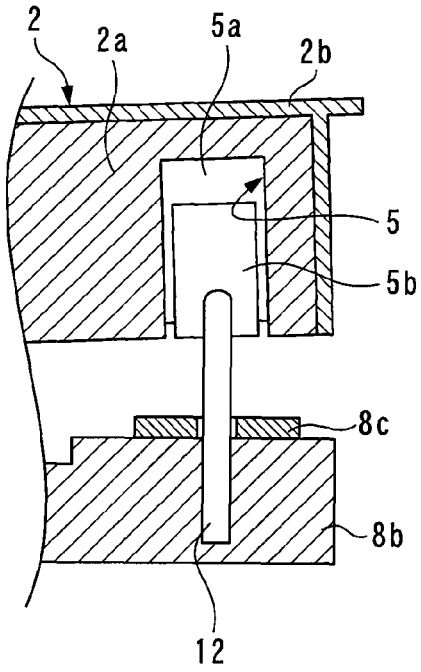
FIG. 4 is a partial longitudinal cross-sectional view of an engaging portion for engaging between a front rail pin and the key.
Figure 5:
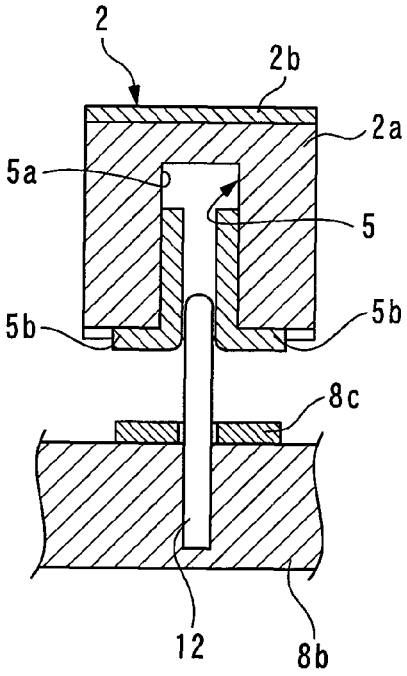
FIG. 5 is a partial transverse cross-sectional view of the engaging portion for engaging between the front rail pin and the key.

Further, as shown in FIGS. 4 and 5, a front rail pin hole 5 is formed in a front end of a lower surface of the key stick 2*a*. The front rail pin hole 5 is a blind hole which has an upper portion closed and a lower portion opening downward, and is in the form of a slit having predetermined fixed width, length and depth.

A pair of left and right pieces 5*b* and 5*b* of bushing cloth (hereinafter referred to as "the bushing cloth sheets 5*b*") are affixed to the front rail pin hole 5 from respective left and right wall surfaces 5*a* and 5*a* thereof to the lower surface of the key stick 2*a*. The bushing cloth sheets 5*b* are made of the same fluorocarbon resin fiber sheets as those of the above-mentioned bushing cloth sheets 4*d* of the balance rail pin hole 4.

On the other hand, as shown in FIG. 1, a keyframe 8 is formed on a keybed (not shown) such that the keyframe 8 extends from a front portion to a central portion of the keybed, and a back rail 9 is formed on a rear portion of the keybed. The keyframe 8 has an keyframe center 8*a* formed on a rear portion thereof, and keyframe fronts 8*b* and 8*b* formed thereon at locations corresponding to respective front ends of the white keys 2 and the black keys 3. The keyframe 8, the keyframe center 8*a*, the keyframe fronts 8*b* and the back rail 9 all extend in the left-right direction.

The keyframe center 8*a* has a large number of balance rail pins 11 erected at locations corresponding to the white keys 2 and the black keys 3. Further, the keyframe fronts 8*b* have a large number of front rail pins 12 erected at locations corresponding to the white keys 2 and the black keys 3. The balance rail pins 11 and the front rail pins 12 are made e.g. of brass, and are circular in cross section. Further, annular punching cloth 8*c* is provided on each base portion of the pins 11 and 12.

Further, a key rest 9*a* made of felt is affixed to the back rail 9. A rear portion of each key 10 is seated on the key rest 9*a* in a key-released state thereof.

As shown e.g. in FIG. 1, the key 10 is mounted on the keyframe 8 in a state in which the balance rail pin hole 4 thereof is engaged with the associated balance rail pin 11 and the front rail pin hole 5 thereof is engaged with the associated front rail pin 12.

With this arrangement, when depressed, the key 10 is pivotally moved about the base portion of the balance rail pin 11 with which the round hole 4*a* of the balance rail pin hole 4 is engaged, while being guided by the balance rail pin 11. During the pivotal motion of the key 10, shakes of the key 10 in the left-right direction are prevented by the front rail pin 12 engaged with the front rail pin hole 5 of the key 10.

Further, as shown in FIGS. 3 and 5, in accordance with the pivotal motion of the key 10, the bushing cloth sheets 4*d* and 4*d* of the balance rail pin hole 4, and the bushing cloth sheets 5*b* and 5*b* of the front rail pin hole 5 slide in contact with the balance rail pin 11 and the front rail pin 12, respectively, whereby the bushing cloth sheets 4*d* and 5*b* serve, thanks to lubricity and flexibility thereof, to prevent the key 10 from wobbling and generating noise during the key depression.

In the present embodiment, the bushing cloth sheets 4*d* and 5*b* are made of fluorocarbon resin fibers, and hence even when environments, such as humidity, are changed, they are not swelled or contracted, whereby the distance between the left and right bushing cloth sheets 4*d* and 4*d* and the distance between the left and right bushing cloth sheets 5*b* and 5*b* are held approximately constant. Further, since the fluorocarbon resin has high abrasion resistance and lubricity, and all the fibers forming the bushing cloth sheets 4*d* and 5*b* are made of the fluorocarbon resin, even if the surfaces of the bushing cloth sheets 4*d* and 5*b* are worn due to a long-term use of the bushing cloth sheets, the excellent abrasion resistance and lubricity of the bushing cloth sheets 4*d* and 5*b* are maintained. As a result, it is possible to stably ensure a smooth pivotal motion of the key 10 while preventing the key 10 from becoming wobbly due to advance of the abrasion of the bushing cloth sheets 4*d* and 5*b,* and generating noise due to degraded lubricity of the same.

Further, all the fibers forming the bushing cloth sheets 4*d* and 5*b* are made of the fluorocarbon resin, so that differently from the conventional bushing cloth, it is possible to dispense with steps e.g. of impregnation for coating the bushing cloth with the fluorocarbon resin, which makes it possible to use commercially available fluorocarbon resin fiber sheets, as in the present embodiment. This makes it possible to reduce the manufacturing costs of the bushing cloth sheets 4*d* and 5*b,* thereby making it possible to manufacture the key 10 at lower costs.

FIG. 6 shows results of a durability test which was performed on the bushing cloth according to the present embodiment, and that performed on Comparative Example. The Comparative Example is a conventional bushing cloth made of wool fibers. Further, the durability tests were performed by commonly mounting bushing cloth made of wool fibers in the balance rail pin holes, mounting the bushing cloth according to the present embodiment and the bushing cloth of Comparative Example in the front rail pin holes, respectively, assembling keys having the bushing cloth mounted therein on the keyframes 8, and then keying 2 million times using a key operation testing machine.

As shown in FIG. 6, as the results of the tests, as for Comparative Example, it was confirmed that the color of surfaces of the bushing cloth mounted in the front rail pin hole was changed to white, and the frictional resistance between the bushing cloth and the front rail pin was increased to thereby degrade the touch feeling of the key. In contrast, in the present embodiment, it was not confirmed at all that the appearance and the touch feeling of the key were changed but it was confirmed that the excellent abrasion resistance and lubricity of the bushing cloth were maintained, and durability of the bushing cloth was improved.

It should be noted that the present invention is by no means limited to the embodiment described above, but it can be practiced in various forms. For example, although in the above-described embodiment, PTFE was used as the fluorocarbon resin for forming the fibers of the bushing cloth, by way of example, this is not limitative, but any other suitable fluorocarbon resin may be used. Further, although in the above-described embodiment, the bushing cloth sheets made of fluorocarbon resin fibers were mounted both in the balance rail pin hole and the front rail pin hole, this is not limitative, but they may be mounted in either the balance rail pin hole or the front rail pin hole.

Furthermore, although in the above-described embodiment, the present invention is applied to the upright piano, by way of example, this is not limitative, but the present invention may be applied to another keyboard instrument, such as a grand piano, which includes keys using bushing cloth for engagement between the key and the pins.

It is further understood by those skilled in the art that the foregoing are preferred embodiments of the invention, and that various changes and modifications may be made without departing from the spirit and scope thereof.

What is claimed is:

1. A key for a keyboard instrument, the key being mounted in a state engaged with a pin and being pivotally moved in accordance with depression of the key, comprising:

a key stick that has a pin hole formed therein, wherein the pin hole includes a guide slot extending in a front-rear direction of the key stick and defined by left and right wall surfaces opposed to each other, and opening downward, and wherein the key stick is pivotally engaged with the pin via the pin hole; and first and second separate sheets of bushing cloth that are each made of fluorocarbon resin fibers, wherein the first and second sheets are respectively affixed to the left and right wall surfaces that define the guide slot of the pin hole;

wherein the first and second separate sheets are the only members which provide for abrasion resistance and lubricity for the coupling between the pin and the key stick.

* * * * *